US005833919A

United States Patent [19]

Hong et al.

[11] Patent Number: 5,833,919

[45] Date of Patent: Nov. 10, 1998

[54] FE-MN-CR-AL CRYOGENIX ALLOY AND METHOD OF MAKING

[75] Inventors: Soon-Hyung Hong, Taejon; Young-Soo Han, Seoul, both of Rep. of Korea

[73] Assignee: Korea Advanced Institute of Science and Technology, Taejon, Rep. of Korea

[21] Appl. No.: 780,709

[22] Filed: Jan. 9, 1997

[51] Int. Cl.[6] ..... C22C 38/38; C21D 8/00

[52] U.S. Cl. ..... 420/62; 420/74; 420/583; 148/608; 148/620; 148/542

[58] Field of Search ..... 420/62, 74, 583; 148/608, 620, 542, 327

[56] References Cited

U.S. PATENT DOCUMENTS

| | | | |
|---|---|---|---|
| 4,847,046 | 7/1989 | Kim | 420/76 |

FOREIGN PATENT DOCUMENTS

| | | | |
|---|---|---|---|
| 57-200543 | 12/1982 | Japan | 420/74 |
| 358067824 | 4/1983 | Japan | 148/620 |
| 1046322 | 10/1983 | Russian Federation | 420/74 |

OTHER PUBLICATIONS

B. W. Oh et al., "Effect of Aluminium on Deformation Mode and Mechanical Properties of Austenitic Fe–Mn–Cr–Al–C Alloys", Materials Science and Engineering, A197:147–156(1995).

Soon H. Hong and Young S. Han, "The Effects of Deformation Twins and Strain–Induced ϵ–Martensite on Mechanical Properties of an Fe–32Mn–12Cr–0.4C Cryogenic Alloy", Scripta Metallurgica et Materialia, 32(9):1489–1494(1995).

Young G. Kim et al., "Low Temperature Mechanical Behavior of Microalloyed and Controlled–Rolled Fe–Mn–Al–C–X Alloys", Metallurgical Transactions A, 16A:1689–1693(1985).

Young G. Kim et al., "Effect of Aluminum Content on Low Temperature Tensile Properties in Cryogenic Fe/Mn/Al/Nb/C Steels", Metallurgical Transactions A, 17A:2097–2098(1986).

J. Charles et al., "New Cryogenic Materials: Fe–Mn–Al Alloys", Metal Progress, 71–74(1981).

Glenn T. Haddick et al., "New Nickel–Free Austenitic Stainless for Ambient and Cryogenic Service", Metal Progress, 37–40(1978).

J. P. Bruner and D. A. Sarno, "An Evaluation of Three Steels for Cryogenic Service", Adv. Cryo. Eng., 24:529–539(1976).

*Primary Examiner*—Deborah Yee
*Attorney, Agent, or Firm*—Darby & Darby

[57] ABSTRACT

The present invention provides a Fe—Mn—Cr—Al cryogenic alloy having high ductility, strength, toughness and corrosion-resistance, and a process for preparing the same. The cryogenic structural alloy of the invention is prepared by the steps of: air-induced melting of a metallic alloy composition which consists of Fe 48.6 to 64.7 wt %, Mn 25.0 to 35.0 wt %, Cr 10.0 to 13.0 wt %, Al 0.1 to 2.0 wt %, C 0.1 to 0.4 wt % and Si 0.1 to 1.0 wt %; hot-rolling of the melted alloy at 1,090° to 1,110 ° C.; and, solution heat treatment of the hot-rolled alloy at 1,040° to 1,060° C. for 50 to 70 minutes. A cryogenic structural alloy of the invention has corrosion-resistance similar to that of conventional 304 stainless steel, higher strength, elongation and toughness than 304 stainless steel, and much higher elongation, corrosion-resistance and toughness than 9% Ni steel; and, therefore, it can be applied for LNG-related facilities including storage tanks, transporting pipes and valves, and transport ships, etc.

2 Claims, 1 Drawing Sheet

FE-MN-CR-AL CRYOGENIX ALLOY AND METHOD OF MAKING

FIELD OF THE INVENTION

The present invention relates to a cryogenic alloy for structural applications, more specifically, to a Fe—Mn—Cr—Al cryogenic alloy having high ductility, strength, toughness and corrosion-resistance, and a process for preparing the same.

BACKGROUND OF THE INVENTION

A variety of cryogenic structural materials have been applied for LNG (liquified natural gas)-related facilities including storage tanks, transporting pipes and valves, and transport ships, etc.

In general, the cryogenic structural materials can be classified into two groups as followings: One is 9% Ni steel according to ASTM A553(hereinafter, referred to as "9% Ni steel") based on ferrite-phase having body-centered cubic structure, which is chiefly used for LNG storage tanks. The other is AISI 304 stainless steel belonging to a Fe—Cr—Ni alloy (hereinafter, referred to as "304 stainless steel") based on austenite-phase having face-centered cubic structure, which is widely used for LNG transporting pipes and valves, and inner wall of LNG storage tanks, etc.

However, the said materials are very expensive and do not have the properties of material required for cryogenic structural applications, e.g., high ductility, strength, toughness and corrosion-resistance. For example, 9% Ni steel whose ductile-brittle transition temperature is decreased to a temperature of below −200° C. through complicate heat treatment, has low corrosion-resistance, ductility and toughness at low temperatures, while it has high yield strength. Moreover, 304 stainless steel has low yield strength at low temperatures, and it is very expensive owing to high content of Ni, though it has high ductility at low temperatures based on austenite-phase and high corrosion-resistance owing to high content of Cr.

Accordingly, in order to overcome the said shortcomings of the cryogenic structural materials, various attempts have been made to prepare an alloy having superior properties for cryogenic structural applications as followings:

J. P. Bruner et al. disclose a cryogenic alloy system which comprises Fe as a basic metal, Mn 19 wt %, Cr 13 wt % and N 0.16 wt %, which can be applied for LNG storage tanks (see: J. P. Bruner et al., Adv. Cryo. Eng., 24:529(1977)).

J. Charles et al. teach a cryogenic alloy system comprising a basic metal of Fe, Mn 30 wt %, Al 5 wt % and C 0.3 wt %, which is ideal for cryogenic applications such as LNG pipe lines (see: J. Charles et al., Metals Progress, 71(1981)).

Also, Y. G. Kim et al. suggest a highly strong cryogenic alloy system which is prepared by controlled rolling of a composition comprising Fe as a basic metal, Mn 30 wt %, Al 5 wt %, C 0.3 wt %, Si and Nb (see: Y. G. Kim et al., Metall. Trans., 16A:1689(1985)).

In addition, U.S. Pat. No. 4,847,046 describes an alloy system comprising Fe, Mn, Al, C, Nb, Si and Cu for use in ultra-low temperature.

The aforesaid cryogenic alloys may be classified into two groups: One is a Fe—Mn—Cr alloy system which is prepared by substituting Ni with Mn in the 304 stainless steel, and the other is a Fe—Mn—Al alloy system which is prepared by substituting Ni and Cr with Mn and Al in the 304 stainless steel, respectively.

However, the Fe—Mn—Cr alloy has revealed to have low ductility and toughness at a temperature for cryogenic applications, e.g., at −196° C., though it has high corrosion-resistance and strength. Also, the Fe—Mn—Al alloy has revealed a problem that it can not practically be used in a corrosive atmosphere due to low corrosion-resistance, though it has high ductility and toughness at extremely low temperatures. Accordingly, the conventional alloy systems are proven to be less satisfactory in light of their cryogenic structural applications.

SUMMARY OF THE INVENTION

The present inventors have made an effort to solve the said problems of the prior art cryogenic alloys, and discovered that an alloy system comprising Fe, Mn, Cr, Al, C and Si has high ductility, strength, toughness and corrosion-resistance, which are essentially required for cryogenic structural applications.

A primary object of the present invention is, therefore, to provide a cryogenic alloy for structural applications, which has high ductility, strength, toughness and corrosion-resistance.

The other object of the invention is to provide a process for preparing the cryogenic alloy in a simple and efficient manner.

BRIEF DESCRIPTION OF DRAWINGS

The above and the other objects and features of the present invention will become apparent from the following description given in conjunction with the accompanying drawings, in which.

DETAILED DESCRIPTION OF THE INVENTION

Figure 1:
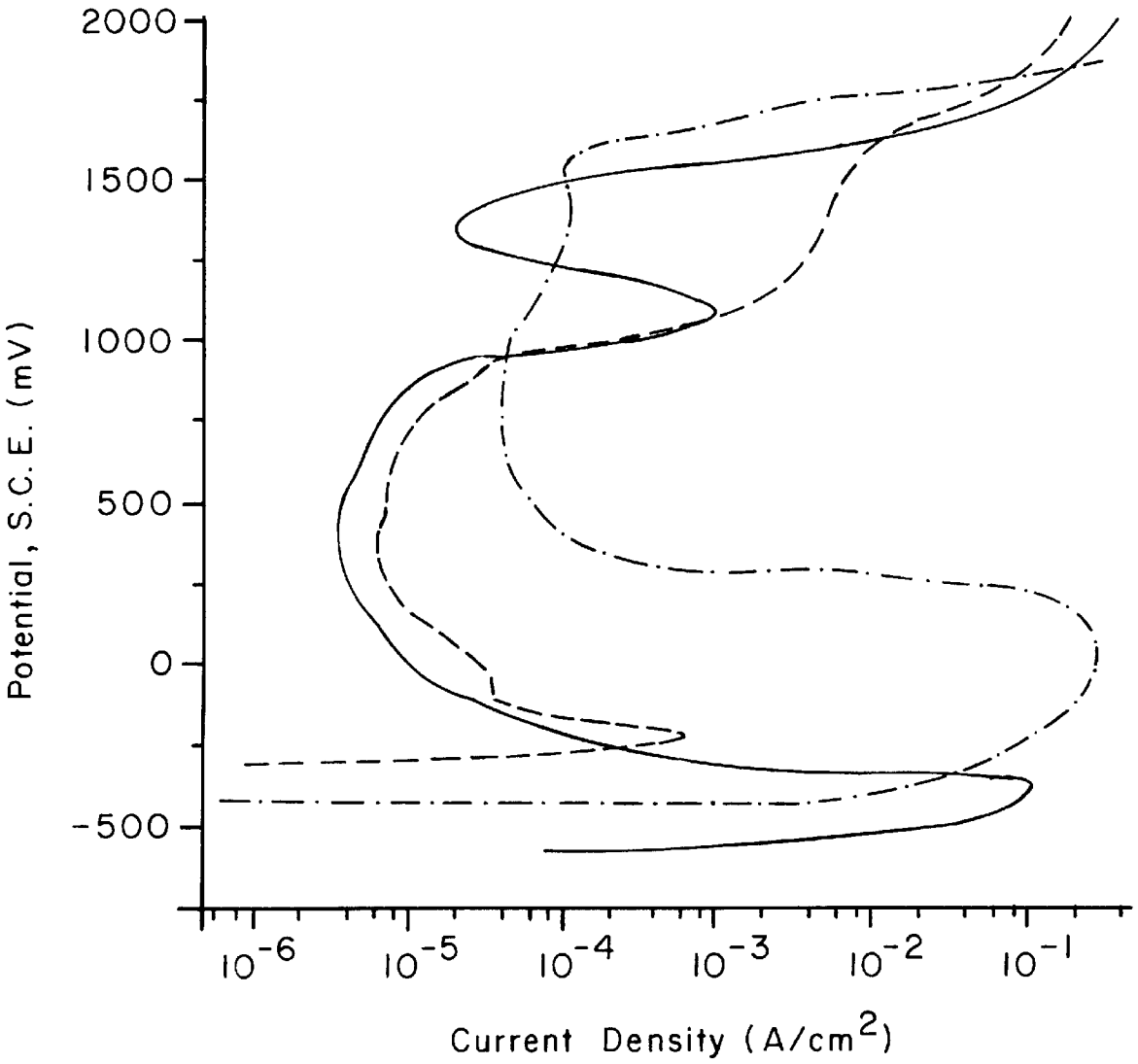
FIG. 1 is a graph showing primary passive potentials of a cryogenic alloy of the invention, conventional 9% Ni steel and 304 stainless steel in accordance with the change of passive current density.

In accordance with the present invention, a cryogenic alloy for structural applications (hereinafter, referred to as "cryogenic structural alloy") is prepared to comprise Fe 48.6 to 64.7 wt %, Mn 25.0 to 35.0 wt %, Cr 10.0 to 13.0 wt %, Al 0.1 to 2.0 wt %, C 0.1 to 0.4 wt % and Si 0.1 to 1.0 wt %.

The cryogenic structural alloy of the invention has austenite structure at a temperature range of 25° C. to −196° C. If the Mn content is lower than 25 wt %, maintenance of austenite phase is not allowed, and if it is higher than 35 wt %, toughness decreases rapidly at low temperatures. Also, if the Cr content is higher than 13 wt %, austenite single phase can not be formed, to have decreased ductility and toughness, and to give Cr carbide which reduces toughness rapidly, and if it is lower than 10 wt %, corrosion-resistance decreases. Further, if the Al content is higher than 2 wt %, austenite single phase is not allowed, which results in decrease of ductility and toughness. Moreover, if the C content is lower than 0.1 wt %, strength decreases and austenite phase can not be formed, and if it is higher than 0.4 wt %, carbides are precipitated, which results in rapid decrease of toughness. Also, if the Si content is lower than 0.1 wt %, the castability becomes deteriorated in the course of preparing an alloy by melting, and if it is higher than 1.0 wt %, toughness decreases rapidly at low temperatures.

In conclusion, the cryogenic alloy of the present invention is formulated to contain maximized Cr content for the improvement of corrosion-resistance, and to contain optimized contents of Mn, Al and C for the maintenance of austenite single phase to guarantee high solid solution hardening.

On the other hand, the cryogenic structural alloy of the invention is prepared by the steps of:

(i) air-induced melting of a metallic alloy composition which consists of Fe 48.6 to 64.7 wt %, Mn 25.0 to 35.0 wt %, Cr 10.0 to 13.0 wt %, Al 0.1 to 2.0 wt %, C 0.1 to 0.4 wt % and Si 0.1 to 1.0 wt %;

(ii) hot-rolling of the melted alloy at 1,090° to 1,110° C.; and, (iii) solution heat treatment of the hot-rolled alloy at 1,040° to 1,060° C. for 50 to 70 minutes.

The cryogenic alloy of the invention does not contain expensive Ni, thus it can be prepared in an economical manner. Also, the alloy of the invention has fine structure of austenite phase, which leads to high ductility, toughness and corrosion-resistance. Moreover, compared to the properties of the conventional cryogenic alloys, the alloy of the invention has corrosion-resistance similar to 304 stainless steel, while ductility, toughness and yield strength are higher than 304 stainless steel, at the same time, ductility, toughness and corrosion-resistance are much higher than 9% Ni steel.

The present invention is further illustrated by the following examples, which should not be taken to limit the scope of the invention.

Examples 1 to 3

Air-induced melting of metallic alloy compositions described in Table 1 below, and hot-rolling of the melted alloy at 1,100° C. and solution heat treatment of the hot-rolled alloy at 1,050° C. for 1 hour were carried out to prepare the cryogenic structural alloys of the invention.

Comparative Examples 1 to 2

Cryogenic structural alloys were prepared in an analogous manner as in Examples 1 to 3, with the exception of employing metallic compositions described in Table 1 below. For reference, compositions of the conventional cryogenic structural alloys, i.e., 304 stainless steel and 9% Ni steel, were shown in Table 1 below.

TABLE 1

Metallic compositions of cryogenic structural alloys

| Alloy system | Composition (wt %) | | | | | | |
|---|---|---|---|---|---|---|---|
| | Fe | Ni | Mn | Cr | Al | C | Si |
| Example 1 | 55.0 | — | 31.9 | 12.3 | 0.1 | 0.3 | 0.4 |
| Example 2 | 58.8 | — | 28.5 | 11.4 | 0.3 | 0.3 | 0.7 |
| Example 3 | 58.5 | — | 28.0 | 11.7 | 0.7 | 0.3 | 0.8 |
| Comparative Example 1 | 53.3 | — | 31.7 | 12.1 | 2.1 | 0.4 | 0.4 |
| Comparative Example 2 | 62.3 | — | 24.0 | 10.7 | 2.0 | 0.6 | 0.4 |
| 304 stainless steel | 70.0 ~74.0 | 18.0 ~20.0 | — | 8.0 ~10.0 | — | 0.08 max | — |
| 9% Ni steel | 90.2 ~91.4 | 8.5 ~9.5 | — | — | — | 0.13 max | 0.15 ~0.30 |

Performance Test of Cryogenic Structural Alloys

(1) Yield Strength and Elongation

Yield strength and elongation of the alloy prepared in Example 2 were determined at 25° C., −40° C., −100° C. and −196° C., respectively, and compared to those of 304 stainless steel and 9% Ni steel. The results were summarized in Table 2 below.

TABLE 2

Yield strength and elongation of cryogenic structural alloys

| Alloy system | Yield strength (MPa) | | | | Elongation (%) | | | |
|---|---|---|---|---|---|---|---|---|
| | 25° C. | −40° C. | −100° C. | −196° C. | 25° C. | −40° C. | −100° C. | −196° C. |
| Example 2 | 284 | 344 | 411 | 437 | 82 | 86 | 82 | 73 |
| 304 stainless steel | 219 | 222 | 228 | 232 | 70 | 55 | 42 | 38 |
| 9% Ni steel | 620 | 673 | 753 | 900 | 35 | 30 | 25 | 21 |

As can be seen in Table 2, it was found that the alloy of the invention has yield strength lower than 9% Ni steel but higher than 304 stainless steel at the test temperatures, and its yield strength at −196° C. was 437 MPa, twice as high as that of 304 stainless steel of 232 MPa. Also, it was revealed that the alloy of the invention has elongation higher than the conventional alloys at the test temperatures, and its percentage of elongation at −196° C. was 73%, twice as high as that of 304 stainless steel of 38%. Moreover, it was determined that the alloy of the invention has elongation above 70% at a temperature range from 25° C. to −196° C., which is caused by inhibited necking phenomenon owing to formation of strain-induced twins during deformation of the alloy.

In addition, elongation of the alloys prepared in Examples 1 to 3 and Comparative Examples 1 to 2 were determined at 25° C., −40° C., −100° C. and −196° C., respectively, and compared to those of 304 stainless steel and 9% Ni steel. The results were summarized in Table 3 below.

TABLE 3

Elongation of cryogenic structural alloys

| Alloy system | Elongation (%) | | | |
|---|---|---|---|---|
| | 25° C. | −40° C. | −100° C. | −196° C. |
| Example 1 | 66 | 65 | 47 | 63 |
| Example 2 | 82 | 86 | 72 | 73 |
| Example 3 | 72 | 74 | 74 | 71 |
| Comparative Example 1 | 43 | 44 | 45 | 32 |
| Comparative Example 2 | 8 | 20 | 26 | 26 |

As can be seen in Table 3, it was found that the alloy of the invention has percentage of elongation above 50% at −196° C. and 25° C., while the alloy prepared in Comparative Example 1 having higher Al content than the alloy of the invention has low elongation at the test temperatures and very low elongation at −196° C., a typical temperature for cryogenic application. Also, it was revealed that the alloy prepared in Comparative Example 2 having higher C content than the alloy of the invention has low percentage of elongation under 30% at the test temperatures.

(2) Impact Energy

Charpy impact energy of the alloy prepared in Example 2 was determined at 25° C., −40° C., −100° C. and −196° C., respectively, and compared to those of 304 stainless steel and 9% Ni steel. The results were summarized in Table 4 below.

TABLE 4

Charpy impact energy of structural alloys

| Alloy system | Charpy impact energy (Joule) | | | |
|---|---|---|---|---|
| | 25° C. | −40° C. | −100° C. | −196° C. |
| Example 2 | 188 | 158 | 152 | 148 |
| 304 stainless steel | 207 | 143 | 124 | 124 |
| 9% Ni steel | 160 | 150 | 128 | 80 |

As can be seen in Table 4, it was found that the alloy of the invention has high impact energy at the test temperatures compared to 9% Ni steel and at the temperature under −40° C. compared to 304 stainless steel. Moreover, it was revealed that the difference in impact energy of the alloy of the invention between 25° C. and −196° C. was only 40J, which suggests that the alloy of the invention has almost the same impact energy over a wide temperature range.

(3) Corrosion-Resistance

To determine corrosion-resistance of the alloy of the invention prepared in Example 2, 304 stainless steel and 9% Ni steel, passive current density and primary passive potential were determined and summarized in Table 5 below. FIG. 1 shows primary passive potentials of the alloys in 1N-$H_2SO_4$ solution at 25° C. in accordance with passive current density.

TABLE 5

Corrosion-resistance of cryogenic structural alloys

| Alloy system | Passive current density (A/cm$^2$) | Primary passive potential (mV) |
|---|---|---|
| Example 2 | $3.6 \times 10^{-6}$ | −382 |
| 304 stainless steel | $7.0 \times 10^{-6}$ | −228 |
| 9% NI steel | $4.3 \times 10^{-5}$ | 51 |

In general, corrosive properties of an alloy are represented as passive current density, pitting potential and primary passive potential, and the higher corrosion-resistance is achieved when the passive current density and primary passive potential are lowered. In FIG. 1, a solid line (—), a dotted line (•••) and a line with dots (—•—) indicate the primary passive potentials of the alloy of the invention, 304 stainless steel and 9% Ni steel, respectively. As can be seen in Table 5 and FIG. 1, it was found that the alloy of the invention shows lower passive current density and primary passive potential in 1N-$H_2SO_4$ solution at 25° C. than those of 9% Ni steel and 304 stainless steel, which demonstrates that the alloy of the invention has high corrosion-resistance.

As clearly illustrated and demonstrated above, the present invention provides a cryogenic structural alloy of the invention which has corrosion-resistance similar to that of conventional 304 stainless steel, much higher strength, elongation and toughness than 304 stainless steel, and higher elongation, corrosion-resistance and toughness than 9% Ni steel. The present invention also provides an economical process for preparing a cryogenic structural alloy with improved properties, which can be applied for LNG-related facilities including storage tanks, transporting pipes and valves, and transport ships, etc.

What is claimed is:

1. A cryogenic structural alloy which consists essentially of 48.6 to 64.7 wt % Fe, 25.0 to 35.0 wt % Mn, 10.0 to 13.0 wt % Cr, 0.1 to 2.0 wt % Al, 0.1 to 0.4 wt % C, and 0.1 to 1.0 wt % Si, wherein said alloy has an austenite structure at a temperature of 25° C. to −196° C.

2. A process for preparing a cryogenic structural alloy which comprises the steps of:

(i) air-induced melting of a metallic alloy composition which comprises 48.6 to 64.7 wt % Fe, 25.0 to 35.0 wt % Mn, 10.0 to 13.0 wt % Cr, 0.1 to 2.0 wt % Al, 0.1 to 0.4 wt % C, and 0.1 to 1.0 wt % Si;

(ii) hot-rolling the melted alloy at 1,090° to 1,110° C.; and (iii) solution heat treating the hot-rolled alloy at 1,040° to 1,060° C. for 50 to 70 minutes.

* * * * *